US005085158A

United States Patent [19]

Goldbeck et al.

[11] Patent Number: 5,085,158

[45] Date of Patent: Feb. 4, 1992

[54] SEWING MACHINE WITH PIPING STRIP CUTTING AND TRANSFER DEVICE

[75] Inventors: Heinz Goldbeck, Bielefeld; Werner Meyer, Enger, both of Fed. Rep. of Germany

[73] Assignee: Durkopp Adler A.G., Fed. Rep. of Germany

[21] Appl. No.: 491,433

[22] Filed: Mar. 9, 1990

[30] Foreign Application Priority Data

Mar. 9, 1989 [DE] Fed. Rep. of Germany ..... 3907571

[51] Int. Cl.[5] ..... D05B 3/18

[52] U.S. Cl. ..... 112/114; 112/68; 112/303

[58] Field of Search ..... 112/68, 70, 105–107, 112/113, 114, 121.12, 121.15, 121.29, 265.2, 303

[56] References Cited

U.S. PATENT DOCUMENTS

| | | | |
|---|---|---|---|
| 3,128,730 | 4/1964 | Simon | 112/105 |
| 3,793,968 | 2/1974 | Beazley | 112/121.29 |
| 3,814,037 | 6/1974 | Nicolay | 112/68 |
| 3,930,453 | 1/1976 | Hintzen et al. | 112/68 |
| 4,034,689 | 7/1977 | Hintzen et al. | 112/70 X |
| 4,589,358 | 5/1986 | Goldbeck et al. | 112/68 |
| 4,658,740 | 4/1987 | Goldbeck et al. | 112/114 |
| 4,665,843 | 5/1987 | Goldbeck et al. | 112/68 |
| 4,694,767 | 9/1987 | Beisler | 112/303 |
| 4,714,035 | 12/1987 | Engle | 112/114 |
| 4,760,808 | 8/1988 | Hülsmann | 112/68 |

FOREIGN PATENT DOCUMENTS

| | | |
|---|---|---|
| 3404758C2 | 2/1984 | Fed. Rep. of Germany . |
| 3531895C1 | 9/1985 | Fed. Rep. of Germany . |
| 405899 | 2/1963 | Switzerland . |

*Primary Examiner*—Werner H. Schroeder
*Assistant Examiner*—Ismael Izaguirre
*Attorney, Agent, or Firm*—Ostrolenk, Faber, Gerb & Soffen

[57] ABSTRACT

A sewing machine, having a device for centrally cutting a piping strip at both of its ends. At least one knife is arranged in a piping strip gripper between the parallel rows of oblique gripping needles. Before the start of the sewing process, a piping strip which has been placed at a predetermined position on a resting plate is held clamped between said plate and the gripper, which is lowered onto the resting plate. By actuation of the knife by an external force such as a pressure fluid, a blade of the knife penetrates into the piping strip and, by horizontal displacement of the knife, the piping strip is incised centrally at its end. Preferably there is a blade for each end of the piping strip.

14 Claims, 7 Drawing Sheets

SEWING MACHINE WITH PIPING STRIP CUTTING AND TRANSFER DEVICE

BACKGROUND OF THE INVENTION

The invention relates to a sewing machine having a device for cutting a piping strip centrally at both its ends, and then the piping strip is transferred from a presentation area, to a sewing workpiece lying on a work area of the sewing machine.

More particularly, it relates to an improved sewing machine which includes a device for transferring a piping strip from a presentation area to a sewing workpiece lying on a work area of the sewing machine; said transferring device comprising a gripper which includes a forming rail and two rows of oblique gripping needles parallel to each other which can be brought by a mover into a position protruding from the forming rail, thereby gripping the piping strip; and means for moving the gripper from the piping-strip presentation position, to the work area. The improvement relates to cutting means mounted on the gripper for cutting at least one of the ends of the piping strip.

One prior device is known from Federal Republic of Germany 35 31 895 C1. In accordance therewith, a piping strip which is placed on a resting plate is pressed by a forming rail which is part of a gripper, referred to as a piping receiver, onto the resting plate at a piping-strip receiving position. Following this, two knives of an incising device, which is mounted on the underside of the resting place and thus is arranged between the resting plate and a top side of a table-top of the sewing machine, are moved slightly upward. In this motion, the cutting edges of the two circular knives dip into a slot-shaped recess provided in the forming rail.

These knives are then moved horizontally, as a result of which the piping strip which is held between the forming rail and the resting plate is cut centrally at its two ends.

This known device has the disadvantage that the space between the resting plate and the table top is so narrowed by the cutting device provided below the resting plate that it interferes with the presenting and aligning of a sewing-material main workpiece in accordance with the light markings.

SUMMARY OF THE INVENTION

In view of these disadvantages, the main object of the invention is to develop a device of this type in which the largest possible free space is present between the resting plate and the top side of the table top.

This object is achieved in a device of this type by providing cutting means mounted on the gripper, preferably between the two rows of gripping needles, for cutting at least one of the ends of the piping strip.

Thus one aspect of the invention is a sewing machine which includes a device for transferring a piping strip; said transferring device comprising a gripper which can be brought by a mover into a position in which it grips the piping strip; and further comprising cutting means mounted on the gripper for cutting at least one of the ends of the piping strip while it is gripped by the gripper.

By the invention, the presentation and alignment of the sewing-material main workpiece is advantageously unimpeded. This piping strip is flatter. As a result, a piping pocket opening can be produced economically and more neatly.

Advantageously, the cutting means comprises at least one knife which is movable between the two rows of gripping needles when the gripping needles are gripping the piping strip, thereby cutting the ends of the piping strip A particularly useful feature is means on the gripper for lowering at least one knife from an inactive upper position into an active lower position and then displacing it transversely to the lowering movement, thereby cutting the piping strip.

Preferably, a resting plate is provided at the presentation area for receiving the piping strip, and is disposed such that an incision edge of the lowered knife enters into a groove provided in the resting plate.

Preferably, the cutting means has two oppositely displaceable knives, one disposed for cutting each of the ends of the piping strip.

BRIEF DESCRIPTION OF THE DRAWINGS

Other objects, features and advantages of the invention will be understood from the following detailed description of a preferred embodiment of the invention, with reference to FIGS. 1–10 of the drawings, in which.

DETAILED DESCRIPTION OF THE PREFERRED EMBODIMENTS

Figure 1:
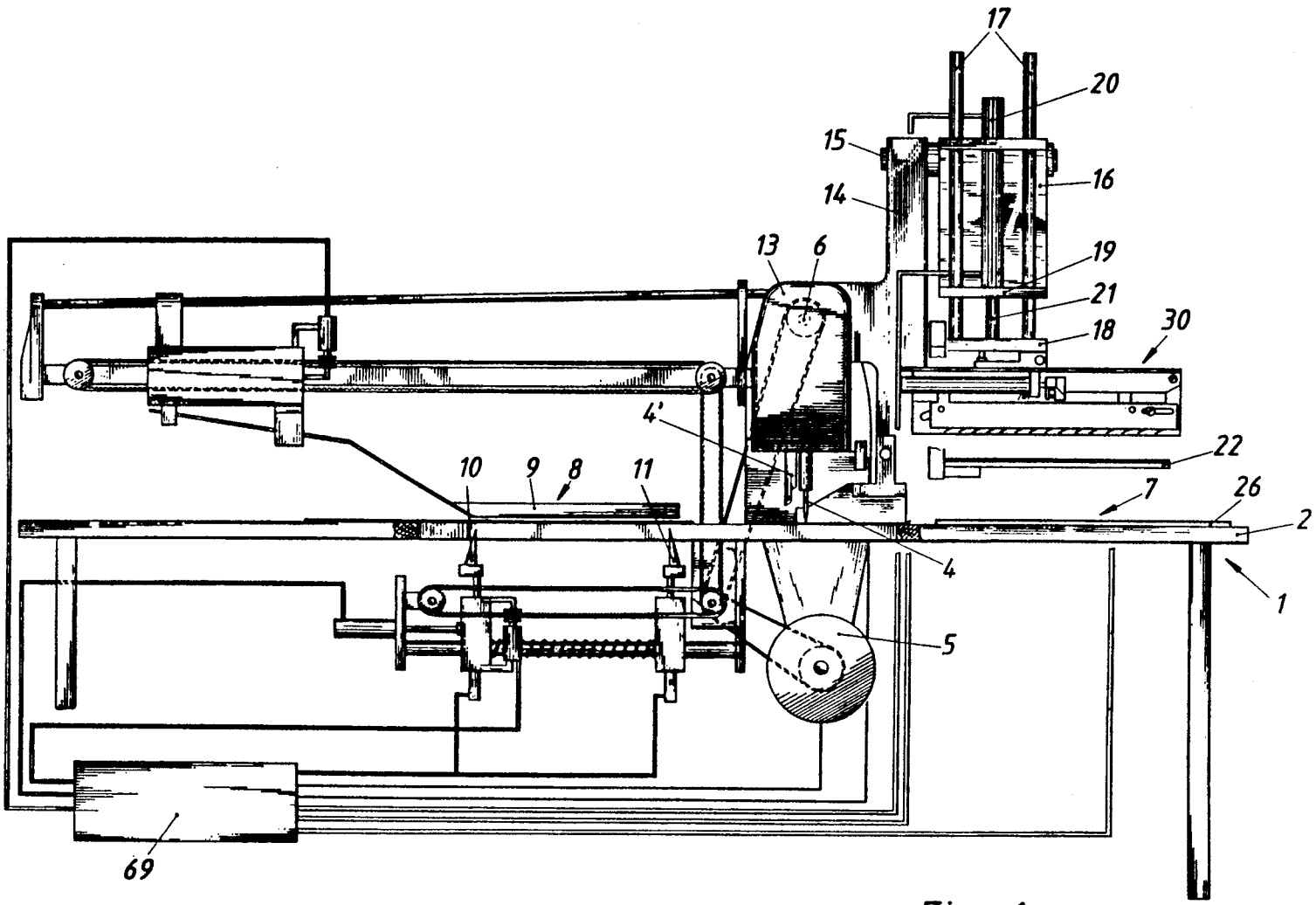
FIG. 1 is a simplified side view of an automatic pocket-opening sewing machine.
Figure 2:
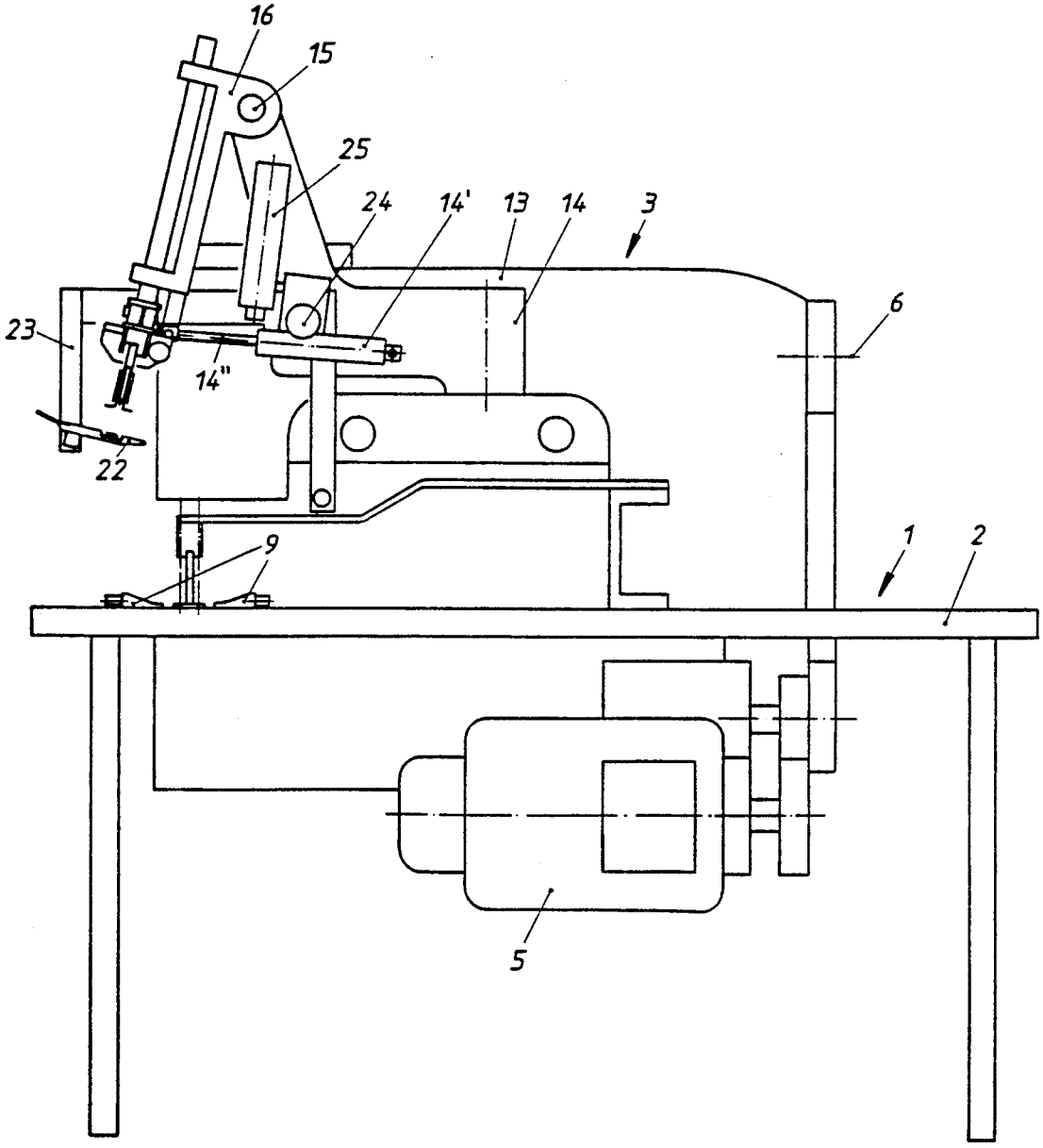
FIG. 2 is a simplified front view of the automatic pocket-opening sewing machine.

The automatic pocket-opening sewing machine shown in FIGS. 1 and 2 is constructed on a frame 1 having a table top 2 which receives a double-needle sewing machine 3 of known construction. A cutting knife 4' is movable up and down between the sewing needles 4 for cutting the slit for the piping pocket opening. A common drive 5 which is provided on the underside of the table top 2 drives an arm shaft 6 of the sewing machine 3, a sewing-material clamp 9 which is movable between a presentation station 7 and a cutting station 8, and a nipping knife 10, which is variable in location. The nipping knife 10 as well as a stationary nipping knife 11 serve to produce angular cuts 12 (FIG. 8) at each end of the aforementioned slit. The functional relationship between the drive 5 and the structural parts or groups of parts just mentioned which are driven by it are known to the prior art.

Firmly attached to an arm 13 of the sewing machine 3 is a bearing bracket 14 which has a journal 15 thereon. A carrier 16 is mounted on the journal 15 and is swingable around the journal 15 by the action of a compressed-air cylinder 14' (FIG. 2) fastened on the arm 13. For this purpose, a piston rod 14" of the compressed-air cylinder 14' is connected to the carrier 16 by a known articulated connection Two guide rods 17 are mounted in the carrier 16. The lower ends of the guide rods 17 are received in a yoke 18 to which they are firmly attached On a lower arm 19 of the carrier 16 is mounted another double-acting compressed-air cylinder 20, the piston rod 21 of which has a threaded extension. The latter is screwed into the yoke 18, whereby the displacement of the retractable and extendable piston rod 21 raises and lowers the yoke 18.

Above the table top 2, within the region of the presentation station 7, a resting plate 22 is fastened to a boom 23. The boom 23, as shown in FIG. 2, is connected via a rod 24 to the bearing bracket 14. On the boom 23 there are furthermore provided at least two marking lights 25 which are variable in position. In accordance with the light markings emitted by the marking lights 25, a sewing-material main workpiece 26 is placed in the presentation station 7 by the operator at a suitable location in view of the position of the piping pocket opening which is to be produced.

Referring now to the detailed views of the gripper 30 shown in FIGS. 3–7, a support beam 28 is fastened to the yoke 18 via a clamp 27. For fastening the gripper 30 to the yoke 18, the right-hand guide rod 17 shown in FIG. 1 protrudes beyond the bottom of the yoke 18. The protruding part of the right-hand guide rod 17 is received by a bore hole in the clamp 27. A pin 27' on the clamp 27 engages a bore in the yoke 18 and prevents the gripper 30 from rotating with respect to the yoke 18. The gripper 30 is secured and locked to the guide rod 17 by tightening a screw 29.

Figure 3:
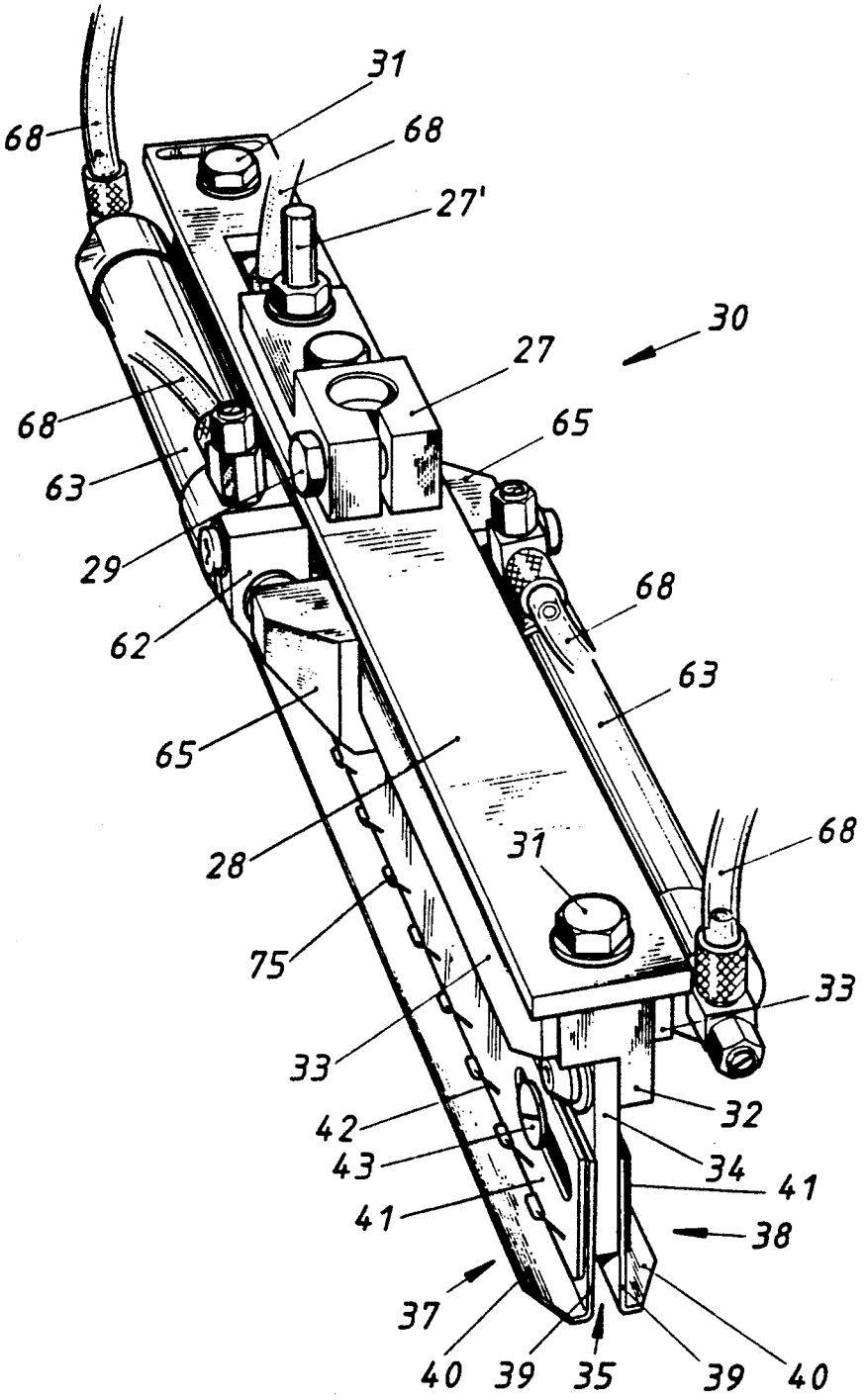
FIG. 3 is a perspective view of the gripper.
Figure 7:
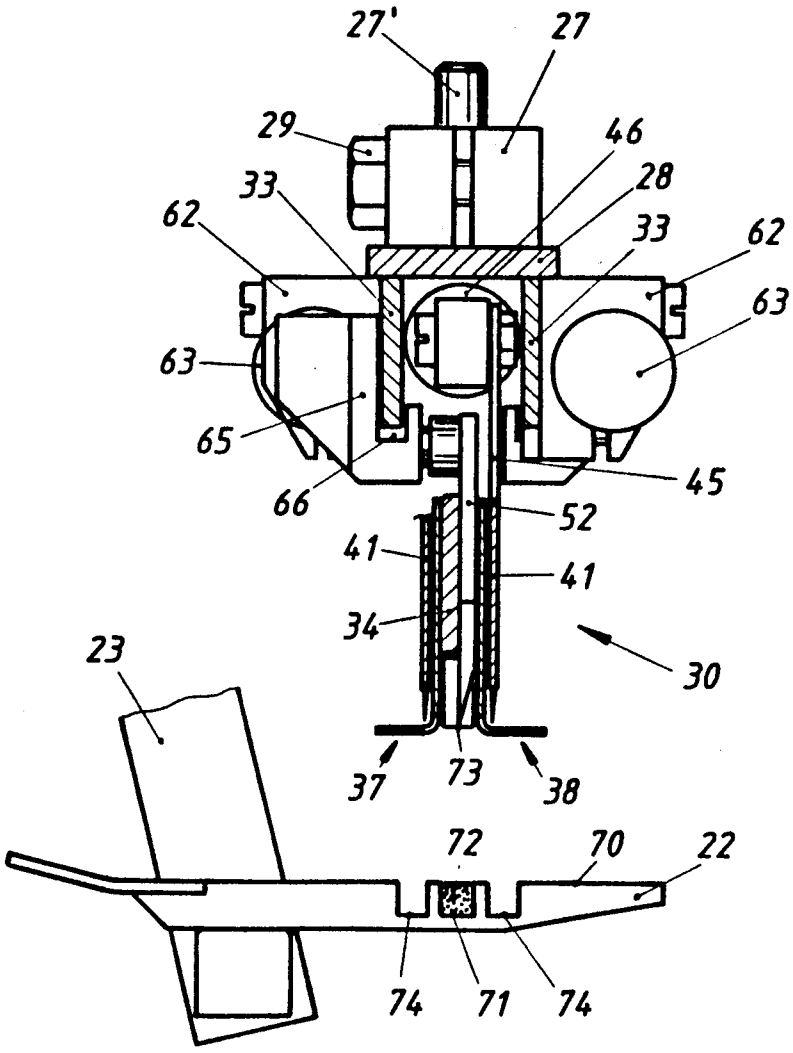
FIG. 7 is a sectional view of the gripper and the resting plate taken along section line 1—1 of FIG. 4.
Figure 8:
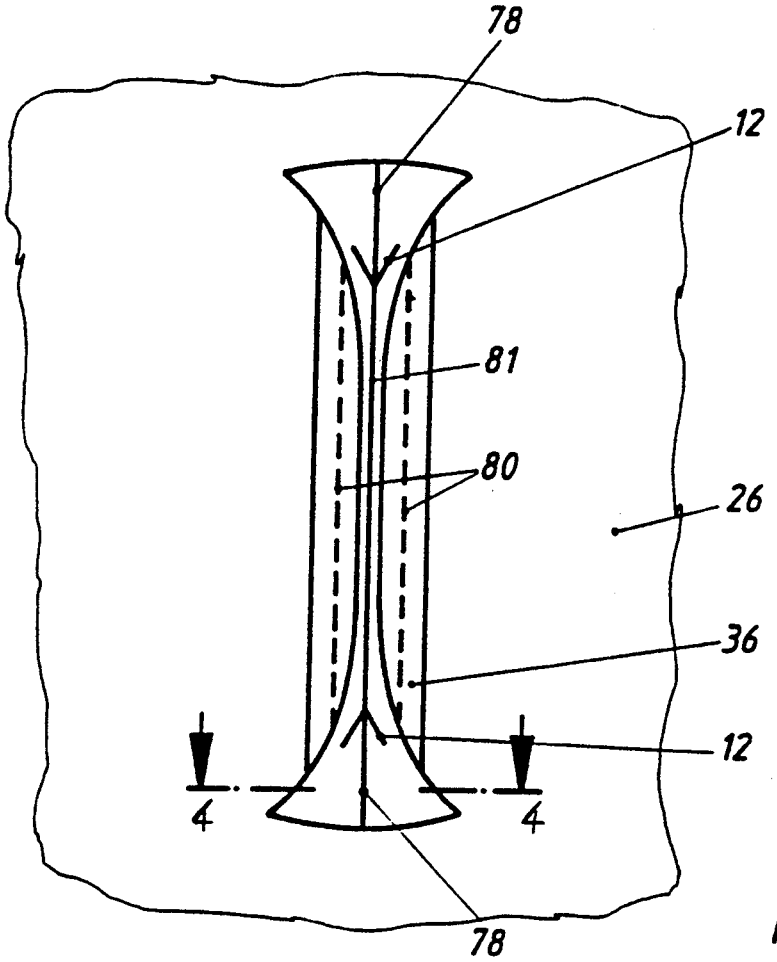
FIG. 8 is a top view of a piping strip sewed onto the main sewing-material workpiece.

A pair of end support brackets 32 are fastened to both ends of the support beam 28 by a pair of screws 31. As shown in FIG. 3, two guide rails 33 and furthermore a center beam 34 are fastened to the two support brackets 32. On the center beam 34 is fastened a forming rail 35 which cooperates in a known manner with the sewing-material clamp 9 to fold a piping strip 36 into the shape of a T as illustrated in FIGS. 7 and 8. The forming rail 35 includes a left-hand angle rail 37 and a right-hand angle rail 38 (see FIG. 3). Each angle rail 37, 38 includes a lengthwise arm 39 and a transverse arm 40, each angle rail 37, 38 being fastened to the center beam 34 by ordinary commercial countersunk screws in the lengthwise arm 39.

Figure 4:
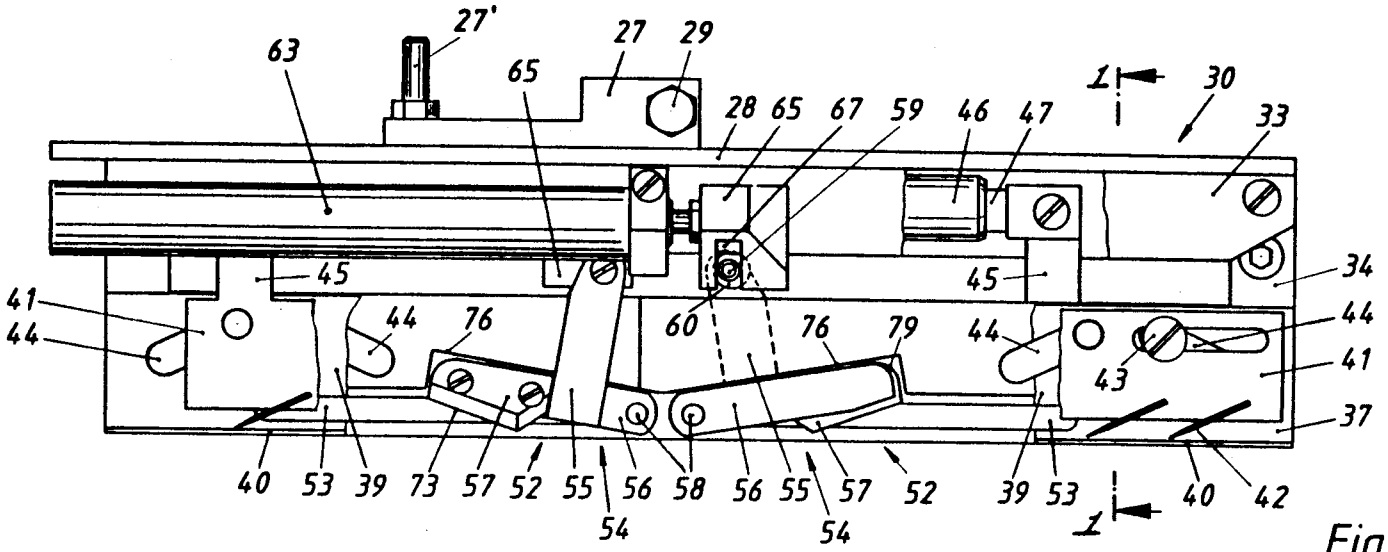
FIG. 4 is a side view of the gripper.

As shown in FIGS. 3 and 4, the lengthwise arms 39 of both angle rails 37, 38 are each covered in part by a gripping plate 41. These gripping plates have been known for a long time to persons skilled in the art. They are provided with oblique gripping needles 42. The two gripping plates 41 (of course four or another member of gripping plates 41 could be provided) are connected to each other by fastening means 43, the fastening means extending through obliquely-directed coinciding slots 44 which are provided in the center beam 34 and the lengthwise arms 39.

The oblique gripping needles 42 in each of the gripping plates 41 are directed oppositely. That is, the gripping needles 42 shown in FIG. 4 are directed obliquely toward the left of FIG. 4 while the gripping needles 42 of the other gripping plate 41, which covers the angle rail 38 (which needles are not visible here) are directed obliquely downward and toward the right of FIG. 4.

As shown in FIGS. 4 and 7, a strap 45 is provided on each gripping plate 41. A mover 46 is disposed between the two straps 45 Preferably, the mover 46 is a single-acting compressed-air cylinder having a piston rod 47 which is connected by known fastening means to the right-hand strap 45, while the end of the cylinder tube of the mover 46 is connected by known fastening means to the strap 45 located on the left in FIG. 4.

Figure 6:
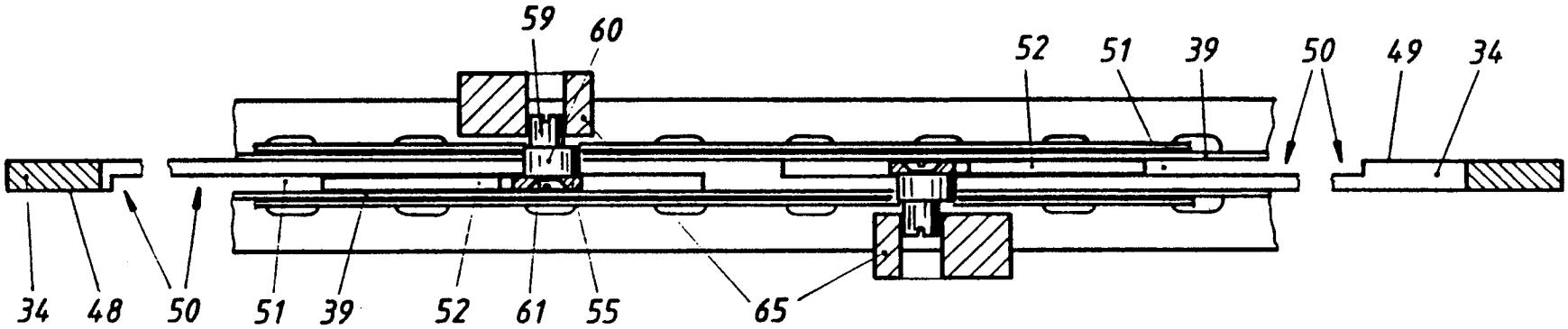
FIG. 6 is a top view of the gripper taken along section line 2—2 of FIG. 5.

As shown in FIG. 6, formed in both longitudinal sides of the center beam 34 (hereinafter the "first side 48" and the "second side 49") are respective wide grooves 50 which extend in each case from near the middle of the center beam 34 approximately to a corresponding end of the center beam 34 (the left end on the first side 48 and the right end on the second side 49). The lengthwise arms 39 of the angle rails 37, 38 fastened to the center beam 34 cover the open side of each groove 50, thereby defining an intervening space 51 at each groove 50, which receives a respective knife 52 in form-locked manner.

Two slots 53 are provided in the lengthwise arm 39 of each of the two angle rails 37, 38, near the transverse arms 40. Each slot is parallel to the corresponding transverse arm 40 and the centers of the slots 53 lie in alignment.

Each knife 52 comprises an angle lever 54 having a first arm 55 and a second arm 56 and a blade 57. The latter is fastened by ordinary commercial countersunk screws to the arm 56 Furthermore, a pin 58 is forced into the arm 56 so that two ends of the pin extend from the two sides of the arm 56 (see FIG. 5*a*). The distance each pin end protrudes is slightly less than the thickness of the material of the lengthwise arm 39. Each pin end of each pin 58 is received by the corresponding slot 53 provided for this purpose. On the end of the first arm 55, a guide pin 59 which carries an eccentric 60 is fastened by a countersunk screw 61 (see FIG. 6).

Figure 5:
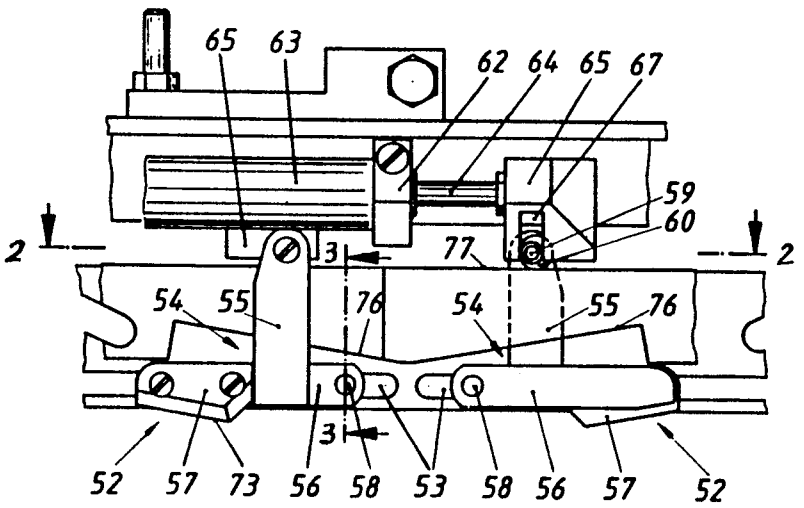
FIG. 5 is a detailed side view of part of the gripper, the knives being in their lowered position.
Figure 5A:
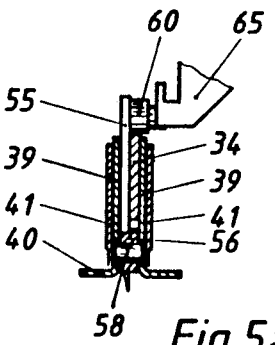
FIG. 5*a* is a sectional view taken along section line 3—3 of FIG. 5, showing the articulated mounting of the knife on both angle rails.

On the outer side of each guide rail 33, as shown in FIGS. 3–5, a mover 63, preferably a double-acting compressed-air cylinder, is fastened via a bearing bracket 62 Its piston rod 64 is provided with a threaded extension on its free end, which extension is received in form-locked manner, as shown in FIGS. 4 and 5, by a slide 65. Within the slide 65 there is a guide groove 66 which, as shown in FIG. 7, partially surrounds the guide rail 33. As shown in FIGS. 4 and 5, a slot 67 which surrounds the guide pin 59 is also provided in the slide 65 The mover 63 as well as the above-mentioned mover 46 can be actuated via hoses 68 by a pressure fluid, the latter being supplied from a source of pressure fluid not shown here, and the start and the duration of the action of the mover being controlled by a control 69 (FIG. 1). Compressed air as well as a hydraulic fluid can be used as the pressure fluid The resting plate 22 (see FIG. 7) has a groove 71 on its side 70 facing the gripper 30. The groove 71 extends between the two lengthwise sides of the resting plate 22 A strip 72 of elastically deformable material, for instance Vulkollan foam, is provided in the groove 71, the strip 72 being tightly attached, preferably by a suitable adhesive, to the groove 71. The strip 72 is provided to momentarily receive the cutting edge 73 which is provided on the blade 57, as shown in FIGS. 4, 5 and 7. Furthermore, two further grooves 74 (see FIG. 7) are provided in the resting plate 22, into which grooves the temporarily extended gripping needles 42 protrude after they have previously passed through the slots 75 in the transverse arms 40.

As shown in FIGS. 4 and 5, oblique indentations 76, which are mirror images of each other, are arranged symmetrically with respect to the middle of the center beam 34. Each second arm 56 of a corresponding angle lever 54 can be received into the corresponding indentation 76 when the slide 65 is retracted as close as possible to the corresponding bearing bracket.

The manner of operation of the disclosed embodiment of the invention will now be described.

In order to produce a piping pocket opening, the sewing-material main workpiece 26 is first of all aligned in the presentation station 7 on the table top 2 in accordance with the light markings projected by the marking lights 25. The piping strip 36 is then placed in a predetermined presentation position on the resting plate 22. After the starting of the operating cycle, the compressed air cylinder 14' is actuated, whereby the gripper 30 which is still in its raised position, is swung from its initial vertically oriented position into the oblique position shown in FIG. 2. The second compressed-air cylinder 20 is then actuated, and as a result its piston rod 21 lowers the gripper 30 until both transverse arms 40 of the angle rails 37, 38 come into contact with the piping strip 36 which has been placed on the resting plate 22.

The mover 46 is now actuated, as a result of which the gripping plate 41 visible in FIG. 4 carries out, as is known, a lowering motion directed obliquely toward the left of FIG. 4, and the second gripping ledge 41 (which lies behind it and is not visible in FIG. 4, but is shown in FIGS. 3 and 7) carries out a lowering motion obliquely to the right of FIG. 4. By these motions, the gripping needles 42 pass through the corresponding slots 75 arranged in the transverse arms 40 and penetrate into the piping strip 36.

The cylinder spaces of both of the movers 63 are now acted on by pressure fluid, which causes the right-hand slide 65 shown in FIG. 4 to move to the right of FIG. 4 along the guide rail 33, and the left-hand slide 65 on the rear of the gripper 30 shown in FIG. 4 to move toward the left of FIG. 4. By the movement of both slides, the angle lever 54 shown to the right in FIG. 4 is moved in clockwise direction via the corresponding guide pin 59 in slot 67. The angle lever 54 arranged on the left is swung in counter-clockwise direction around its corresponding pin 58. In this way, as shown in FIG. 5, each arm 56 is removed from the corresponding indentation 76, with the result that each blade 57 penetrates into the piping strip 36, which is held taut by the gripping plates 41 and needles 42. The aforementioned swinging of the two angle levers 54 ends when, as can be noted from FIG. 5, the circumference of the eccentric 60 contacts an upper edge 77 of the center beam 34. By loosening the countersunk screw 61 (FIG. 6), the position of the eccentrics 60 can be changed, as a result of which the depth of penetration of the blades 57 can be varied.

Figure 9:
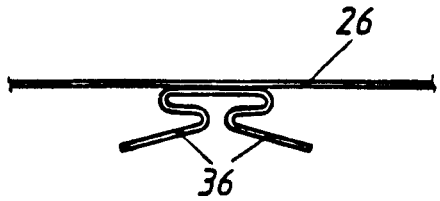
Fig. 9 PRIOR ART
FIG. 9 is a sectional view of a conventional piping strip taken along section line 4—4 in FIG. 8, the ends of the piping strip not being cut.
Figure 10:
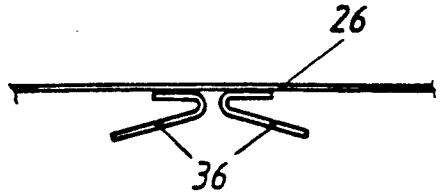
FIG. 10 is a sectional view along a section line 4—4 in FIG. 8, the ends of the piping strip being cut.

After both arms 56 have left their indentations 76, as can be noted in FIG. 5, the right-hand knife 52 moves into its end position toward the right and the left-hand knife 52 moves into its end position toward the left. The swinging of the arms 56 into as well as out of the corresponding indentations 76 is guided and made possible by a rounding 79 (see FIGS. 4 and 5) provided on each arm 56 as well as on each blade 57. By the horizontal displacement of the two knives 52 which has just been mentioned, the incisions 78 (FIG. 8) are made at both ends of the piping strip 36 In this way the result is obtained that the piping strip 36 sewed onto the sewing-material main part 26, after turning, as shown in FIG. 10, has only two layers of material at the ends of the pocket opening. In contrast, in the case of a traditionally sewed-on piping strip 36 with non-incised ends, after the turning of the piping strip 36 sewed on the main workpiece 26, there are three layers of material, as shown in FIG. 9. Thus, by cutting the piping strip at both of its ends, better pocket openings with piping are made possible, since thickening of the two ends of the finished pocket opening is avoided After the incisions 78 have been made, the corresponding cylinder spaces of the movers 63 are acted on in the reverse direction, which moves the knives 52 back into their initial position, as seen in FIG. 4.

By corresponding action on the compressed-air cylinder 20, the gripper 30 is then moved away from the resting plate 22, the piping strip 36 being taken off from the resting plate 22 by the gripping needles 42.

The compressed-air cylinder 14' is then acted on correspondingly, as a result of which the gripper 30 is swung into its vertical position. Now, by suitable action on the compressed-air cylinder 20, the piping strip 36 is transferred to the sewing-material clamp in a conventional manner, clamped fast there and then folded into a T-shape by cooperation of the gripper 30 with the sewing-material clamp 9. The two seams 80 and at the same time a middle incision 81 are then produced, the previously effected incisions 78 extending in alignment with the middle incision 81. The middle incision 81, as is known, provides the aforementioned slit of the pocket opening. After completion of the sewing process, the sewing-material workpiece 26 is brought, together with the piping strip 36 now sewed onto it, into the cutting station 8 where the two angle incisions 12 are finally produced by the nipping knives 10 and 11.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for transferring a piping strip from a presentation area of a sewing machine, to a sewing workpiece lying on a work area of the sewing machine;

said transferring device comprising a gripper including a rail and rows of oblique gripping needles, and moving means for moving said needles into a position protruding from the rail, thereby gripping the piping strip;

means for moving the gripper from the piping-strip presentation area, to the work area; and cutting means mounted on the gripper between the rows of gripping needles, for cutting at least one end of the piping strip.

2. A device according to claim 1, wherein said cutting means comprises at least one knife and means for moving said knife between the rows of gripping needles when said gripping needles are gripping said piping strip, thereby cutting at least one end of the piping strip.

3. A device according to claim 2, wherein said moving means on the gripper is for moving said at least one knife in a first direction from an inactive position into an active position and then displacing said knife transversely to said first direction, thereby cutting said piping strip.

4. A device according to claim 3, wherein the cutting means has two knives which are displaceable in opposite directions, each of which includes an angle lever having a first arm and a second arm; a blade is fastened to the second arm; and a pin with pin ends protruding on both sides is attached to said second arm; and a guide pin having an eccentric is provided on the end of the first arm away from the second arm.

5. A device according to claim 4, wherein a pair of grooves are formed on respective longitudinal sides of the center beam; each groove is enclosed by the longitudinal arm of a respective angle rail; and an intermediate space which is formed by the groove and the longitudinal arm receives a respective one of the knives.

6. A device according to claim 5, wherein two slots are provided in each longitudinal arm, extending in alignment parallel to a transverse arm of the angle rail; each of which slots receives a pin end of the pin; and the protruding part of each pin end is slightly smaller than a thickness of the material of the longitudinal arm.

7. A device according to claim 3, wherein the means for lowering the knife comprises a cylinder fastened on the gripper which is actuated by pressure fluid by means of a control; a slide is connected to a free end of a piston rod of the cylinder; said slide being displaceable and guided by means of a guide groove on the gripper.

8. A device according to claim 3, further comprising a resting plate at the presentation area for receiving said piping strip, and disposed such that an incision edge of the lowered knife enters into a groove provided in the resting plate.

9. A device according to claim 4, wherein a groove is formed in a side of the resting plate facing the gripper and located for receiving said knife; and the groove is filled with a strip of elastically deformable material.

10. A device according to claim 1, wherein the gripper comprises a center beam, two angle rails fastened on opposite sides of the center beam, and two gripping plates connected with the gripping needles, each of the gripping plates extending parallel to said center beam and adjacent to a longitudinal arm of a respective angle rail.

11. A device for transferring a piping strip; said transferring device comprising a gripper and means for moving the gripper into a position in which the gripper grips the piping strip; and further comprising cutting means mounted on the gripper for cutting at least one part of the piping strip while it is gripped by the gripper.

12. A device according to claim 11, wherein said gripper has gripping needles for gripping the piping strip, and said cutting means is mounted among said gripping needles.

13. A device according to claim 12, wherein said cutting means comprises at least one knife and means for moving said knife between the gripping needles when said gripping needles are gripping said piping strip, thereby cutting at least one end of the piping strip.

14. A device according to claim 13, wherein said moving means on the gripper is for moving said at least one knife in a first direction from an inactive position into an active position and then displacing said knife transversely to said first direction, thereby cutting said piping strip.

* * * * *